US006041605A

United States Patent [19]

Heinrichs

[11] Patent Number: 6,041,605

[45] Date of Patent: Mar. 28, 2000

[54] COMPRESSOR PROTECTION

[75] Inventor: Anton D. Heinrichs, Wilson, N.Y.

[73] Assignee: Carrier Corporation, Syracuse, N.Y.

[21] Appl. No.: 09/080,338

[22] Filed: May 15, 1998

[51] Int. Cl.[7] ..... F25B 31/00; F25B 43/02

[52] U.S. Cl. ..... 62/84; 62/193; 62/505

[58] Field of Search ..... 62/505, 228.3, 62/193, 228.5, 93

[56] References Cited

U.S. PATENT DOCUMENTS 4,197,719 4/1980 Shaw ..... 62/505 X 4,573,324 3/1986 Tischer ..... 62/505 X 5,873,255 2/1999 Madigan ..... 62/505 X

*Primary Examiner*—William Wayner

[57] ABSTRACT

Responsive to a request for refrigeration, a start up sequence is initiated and, if start up is achieved, a number of motor and compressor parameters of operation are sensed for controlling and protecting the compressor. Depending upon the nature of the sensed conditions, if necessary, the motor, and thereby the compressor, is either disabled or corrective action is initially taken to bring the parameters within an acceptable range. If corrective action is ineffective, the motor and thereby the compressor, is disabled.

10 Claims, 3 Drawing Sheets

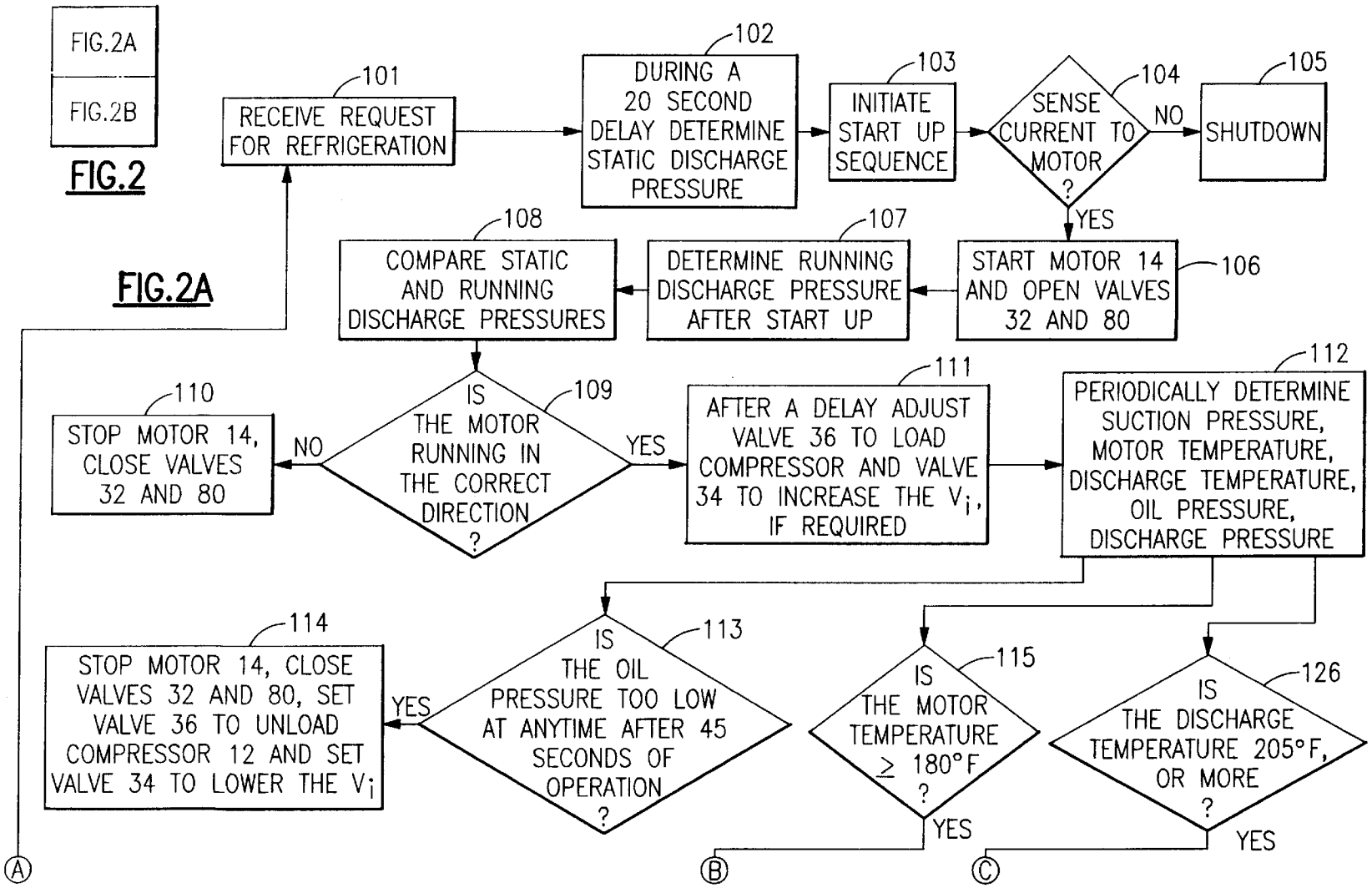
101
RECEIVE REQUEST FOR REFRIGERATION
102
DURING A 20 SECOND DELAY DETERMINE STATIC DISCHARGE PRESSURE
103
INITIATE START UP SEQUENCE
104
SENSE CURRENT TO MOTOR ?
NO
YES
105
SHUTDOWN
106
START MOTOR 14 AND OPEN VALVES 32 AND 80
107
DETERMINE RUNNING DISCHARGE PRESSURE AFTER START UP
108
COMPARE STATIC AND RUNNING DISCHARGE PRESSURES
109
IS THE MOTOR RUNNING IN THE CORRECT DIRECTION ?
YES
NO
110
STOP MOTOR 14, CLOSE VALVES 32 AND 80
111
AFTER A DELAY ADJUST VALVE 36 TO LOAD COMPRESSOR AND VALVE 34 TO INCREASE THE $V_i$, IF REQUIRED
112
PERIODICALLY DETERMINE SUCTION PRESSURE, MOTOR TEMPERATURE, DISCHARGE TEMPERATURE, OIL PRESSURE, DISCHARGE PRESSURE
113
IS THE OIL PRESSURE TOO LOW AT ANYTIME AFTER 45 SECONDS OF OPERATION ?
YES
114
STOP MOTOR 14, CLOSE VALVES 32 AND 80, SET VALVE 36 TO UNLOAD COMPRESSOR 12 AND SET VALVE 34 TO LOWER THE $V_i$
115
IS THE MOTOR TEMPERATURE ≥ 180°F ?
YES
126
IS THE DISCHARGE TEMPERATURE 205°F, OR MORE ?
YES
A
B
C
FIG.2A
FIG.2B
FIG.2
FIG.2A

COMPRESSOR PROTECTION

BACKGROUND OF THE INVENTION

Compressors used in commercial refrigeration applications, typically, include a number of safety features as well as LED indicators to indicate operating conditions and mode of failure. Reverse operation, excess motor temperature, low oil pressure and excess discharge pressure are typical modes of failure. The failure mode may be inherent such as due to miswiring or due to changed conditions such as increased loading, clogged oil filter, etc.

SUMMARY OF THE INVENTION

Various parameters are sensed and responsive thereto, the system is shut down or corrective changes are made. Conditions such as reverse operation and low oil pressure cause the disabling of the system. Excess motor temperature and excess discharge temperature cause the initiation of a motor cooling flow. If the motor cooling flow cannot keep the motor and/or discharge temperature low enough, the system is unloaded and ultimately disabled if an acceptable temperature cannot be achieved within a predetermined time period. Upon the cooling of the motor and/or discharge line to an acceptable temperature after disabling, the system will again be activated responsive to a request for refrigeration.

It is an object of this invention to control compressor operation.

It is another object of this invention to provide protection against adverse compressor operation. These objects, and others as will become apparent hereinafter, are accomplished by the present invention.

Basically, a number of motor and compressor parameters of operation are sensed. Depending upon the nature of the sensed conditions, the motor, and thereby the compressor, is either disabled or corrective action is initially taken to bring the parameters within an acceptable range. If corrective action is ineffective, the motor, and thereby the compressor, is disabled.

BRIEF DESCRIPTION OF THE DRAWINGS

For a fuller understanding of the present invention, reference should be made to the following detailed description thereof taken in conjunction with the accompanying drawings wherein:

FIG. 2 shows how FIGS. 2A and 2B are related; and FIGS. 2A and 2B together are a flow diagram showing the operation of the system according to the teachings of the present invention.

DESCRIPTION OF THE PREFERRED EMBODIMENT

Figure 1:
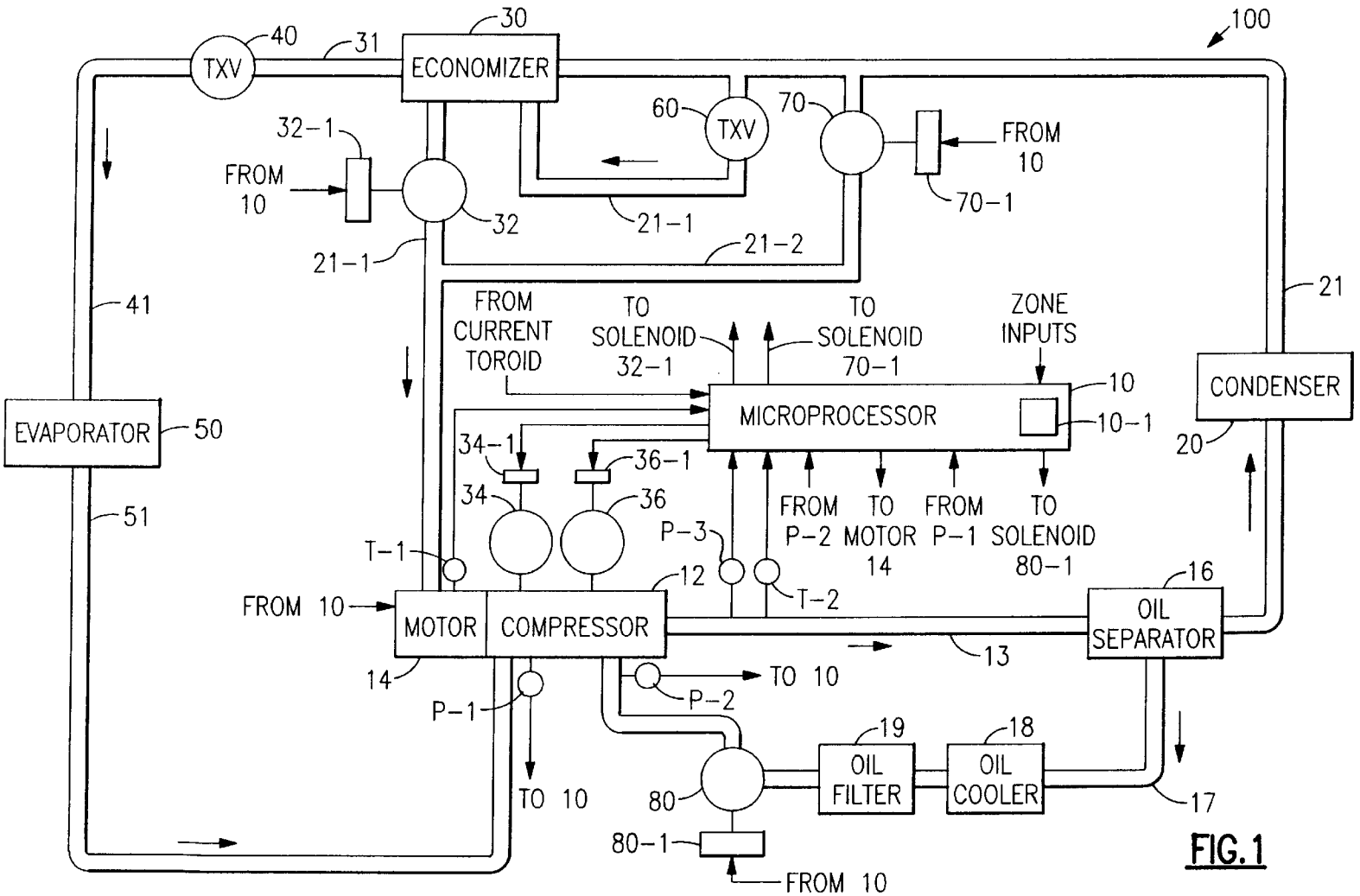
FIG. 1 is a schematic representation of a commercial refrigeration system.

In FIG. 1, the numeral 100 generally designates a commercial refrigeration system which is under the control of microprocessor 10. The numeral 12 generally designates a semi-hermetic screw compressor which is driven by motor 14. Starting with compressor 12, system 100 serially includes discharge line 13 containing, oil separator 16, condenser 20, line 21, economizer 30, line 31, thermal expansion valve (TXV) 40, line 41, evaporator 50, and suction line 51. Economizer line 21-1 contains thermal expansion valve (TXV) 60 which controls flow in line 21-1. Flow through economizer 30 via line 21-1 is supplied via motor 14 and the economizer port (not illustrated) to compressor 12 at an intermediate point in the compression process.

The present invention adds details of the microprocessor control and branch line 21-2 which supplies a cooling flow of liquid refrigerant to motor 14 under the control of solenoid valve 70. Line 21-2 feeds into economizer line 21-1 which is connected to motor 14 and compressor 12 via the economizer port (not illustrated). The coolant/economizer flow passes from motor 14 via internal passages (not illustrated) which direct the economizer/cooling flow into the rotor compartment of compressor 12. Thermal sensors T-1 and T-2 sense the motor temperature and the compressor discharge temperature, respectively, and communicate that information to microprocessor 10. Pressure sensors P-1, P-2 and P-3 sense suction pressure, oil pressure and discharge pressure, respectively, and communicate that information to microprocessor 10. Microprocessor 10 also receives input(s) from the zone(s) indicating a demand for cooling and from the current toroid (not illustrated) which is on a lead to motor 14 and which indicates whether or not power is being supplied to the motor 14. Microprocessor 10 controls motor 14, solenoid 32-1 for controlling solenoid valve 32 in line 21-1, solenoid 34-1 for controlling Vi valve 34, solenoid 36-1 for controlling unloader valve 36, solenoid 70-1 for controlling valve 70 in line 21-2, and solenoid 80-1 for controlling oil return into the compressor 12.

When the system 100 is shut down, valve 80 is closed to prevent oil from collecting in compressor 12, similarly, valves 32 and 70 are closed to prevent the migration of liquid refrigerant to compressor 12 and valve 36 is opened to unload compressor 12. Valve 34 would be at a position corresponding to a low Vi so as to ease starting.

In the operation of system 100 after shut down, a need for cooling is sensed. During a twenty second delay, the static discharge pressure is determined via pressure sensor P-3. The start up sequence is then initiated and microprocessor 10 provides power and senses via the current toroid whether or not the motor 14 is powered and starts motor 14. If no current is sensed the motor 14 is not started. If motor 14 is started, valves 32 and 80 are opened. After a time period of at least thirty seconds after motor 14 is started, valve 34 is positioned to provide the desired Vi and valve 36 is positioned to load compressor 12. Motor 14 drives compressor 12 such that hot, high pressure refrigerant gas from compressor 12 is supplied via discharge line 13 and oil separator 16 to condenser 20 where the separated refrigerant gas condenses to a liquid which is supplied via line 21 to economizer 30 and then via line 31 to expansion valve 40. Expansion valve 40 causes a pressure drop and a partial flashing of the liquid refrigerant passing therethrough. The liquid refrigerant supplied via line 41 to evaporator 50 evaporates to cool the region/zone requiring cooling and the resultant gaseous refrigerant is supplied via suction line 51 to compressor 12 to complete the cycle.

At start up, responsive to a call for refrigeration, in addition to starting motor 14, and thereby compressor 12, a start up sequence takes place in addition to the sensing of power being supplied to motor 14. Initially, during the delay prior to starting motor 14, the static discharge pressure is sensed via pressure sensor P-3. The motor 14 is then started and valves 32 and 80 are opened. The discharge pressure sensed by pressure sensor P-3 is monitored starting about 1 second after start up and continuing for about 15 seconds. If during that time the sensed discharge pressure drops more than 10 psi below the initially sensed static discharge pressure, the motor 14 is stopped since the reduction in discharge pressure is indicative of reverse operation of the compressor 12 as due to miswiring or phase reversal. Additionally, valves 32 and 80 are closed.

Motor cooling and discharge temperature are related in that refrigerant supplied for cooling the motor and/or economizer operation is subsequently supplied to the compressor rotor compartment at intermediate pressure and this also reduces the discharge temperature. Temperature sensor T-1, which would normally be internal to motor 14, senses the motor temperature and temperature sensor T-2 senses the discharge temperature. If the motor temperature sensed by sensor T-1 is in excess of 180° F. or if the discharge temperature sensed by sensor T-2 is in excess of 205° F., microprocessor 10 causes solenoid 70-1 to be actuated opening valve 70 and permitting liquid refrigerant to pass from line 21 via valve 70, line 21-2 and line 21-1 into motor 14 where the motor is cooled. The flashed refrigerant then passes via internal compressor passages (not illustrated) into the compressor rotor compartment (not illustrated) of compressor 12 at intermediate pressure. This gas tends to provide a cooling effect which reduces the discharge temperature. Solenoid 70 will be kept open until the triggering temperature is reduced to 165° F. in the case of motor 14 or 190° F. in the case of the compressor discharge temperature. However, upon the motor temperature sensed by sensor T-1 reaching 220° F., solenoid 36-1 is activated to cause unloader valve 36 to unload the compressor 12. The compressor 12 would remain unloaded until the motor temperature sensed by sensor T-1 reaches 205° F. If the motor temperature sensed by sensor T-1 is greater than or equal to 240° F. or if the discharge temperature sensed by sensor T-2 is greater than or equal to 230° F., motor 14 is shutdown. It should be noted that compressor 12 is not unloaded responsive to excessive discharge temperatures. Also, when the motor and discharge temperatures fall to 205° F., or less, after shut down, the system 100 could again be activated responsive to a request for refrigeration.

The suction pressure is sensed by sensor P-1 and the oil pressure in compressor 12 is sensed by sensor P-2 and the differential is determined by microprocessor 10. If the oil pressure sensed by sensor P-2 is not more than the pressure sensed by sensor P-1 by 45 psi for a continuous period of forty five seconds, motor 14 is shut off and valves 32 and 80 are closed. Additionally, valve 36 is positioned to unload compressor 12 and valve 34 is positioned to lower the Vi if motor 14 is shut off responsive to low oil pressure. The flow in discharge line 13 passes through oil separator 16 where entrained oil is removed from the refrigerant gas. The collected separated oil passes from oil separator 16 via line 17 which leads back to compressor 12 and serially contains oil cooler 18, oil filter 19, and solenoid valve 80. The oil pressure sensed by sensor P-2 is compared to the discharge pressure sensed by sensor P-3 so as to protect compressor 12 from operation when the oil filter 19 requires maintenance, as evidenced by increased flow resistance resulting in a lower pressure sensed by sensor P-2. If the pressure sensed by sensor P-3 exceeds the pressure sensed by sensor P-2 by 50 psi for 15 continuous seconds, an alarm is activated. If P-3 exceeds P-2 by 80 psi for 15 continuous seconds, motor 14 is shut off and valves 32 and 80 are closed. Additionally, valve 36 is positioned to unload compressor 12 and valve 34 is positioned to lower the Vi if motor 14 is shut off responsive to a clogged oil filter.

There is an optimal discharge to suction pressure ratio or Vi. Assuming that a 5 to 1 ratio is desired, starting at least 30 seconds after start up, the suction pressure is sensed by sensor P-1 and the discharge pressure is sensed by sensor P-3. Conventional screw compressors have a built-in volume ratio adjusting valve 34 and a capacity control or unloader valve 36. Since volume varies inversely with pressure, the volume ratio can be regulated by controlling the position of the volume ratio adjusting valve responsive to the pressures sensed by sensors P-1 and P-3. Assuming a desired 5 to 1 ratio, the volume ratio adjusting valve 34 would be appropriately energized/de-energized by providing power to solenoid 34-1 if, typically, the ratio was out of the deadband such as a 4.9 to 1 to a 5.1 to 1 ratio range. During operation, the operating conditions and alarms would be displayed by indicator panel 10-1 of microprocessor 10.

Figure 2B:
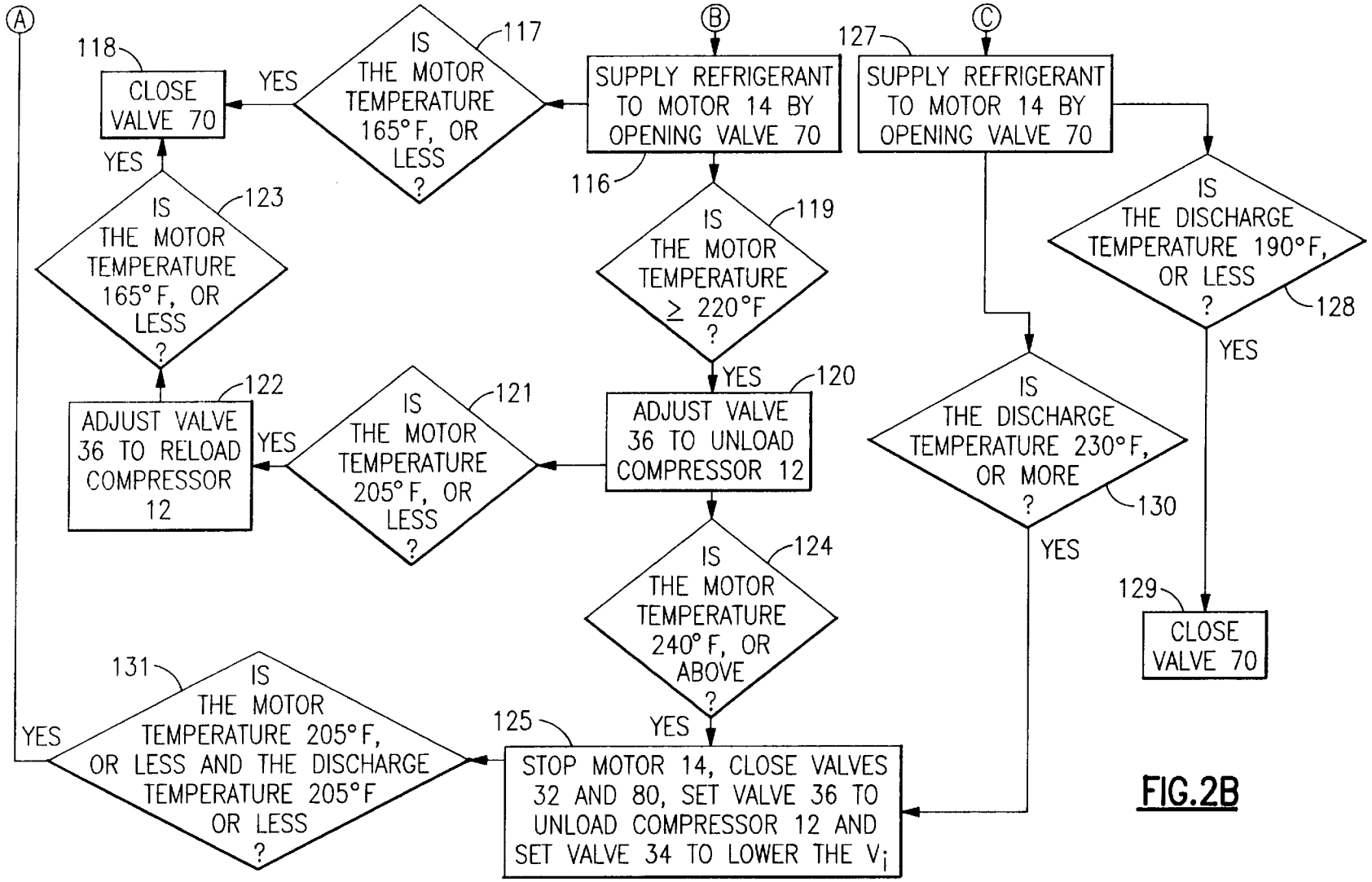

FIGS. 2A and 2B together show a flow diagram of the operation of the system for the present invention. Assuming that system 100 is shutdown, valves 32 and 80 will be in the closed position. Additionally, valve 36 is positioned to unload compressor 12 and valve 34 is positioned to lower the Vi. Upon the receipt of a request for refrigeration in a zone, as indicated by block 101, there is a twenty second time delay during which the static discharge pressure is determined via pressure sensor P-3, as indicated by block 102. A start up sequence is initiated, as indicated by block 103, and includes the supplying of power to motor 14. The supplying of current to motor 14 is sensed via a current toroid on a lead to the motor 14, as indicated by block 104. If no current is sensed the system is shut down as indicated by block 105. If a current is sensed, motor 14 is started to drive compressor 12 and valves 32 and 80 are opened, as indicated by block 106. The discharge pressure is determined after start up, as indicated by block 107 and is compared to the static discharge pressure, as indicated by block 108. By comparing the static and running discharge pressures it can be determined whether the compressor is running in the correct direction and acting as a compressor or running in reverse and acting as a vacuum pump. The direction of running of motor 14 and thereby compressor 12 is determined, as indicated by block 109. If motor 14 is running in the wrong direction it is shut off and valves 32 and 80 are closed, as indicated by block 110. If motor 14 is running in the correct direction, after a delay to permit an easy start of compressor 12, Vi valve 34 and unloader valve 36 are regulated to make compressor 12 responsive to the refrigeration demand, as indicated by block 111. During operation a number of conditions are periodically monitored to determine conditions requiring correction or disabling of the system, and to monitor the results of corrective actions as indicated by block 112. The oil in separator 16 is at discharge pressure and is returned to compressor 12 via oil cooler 18 and oil filter 19. If oil filter 19 becomes clogged, the resistance to flow increases and the pressure of the oil being returned to compressor 12 drops. As indicated by block 113, after forty five seconds of operation to permit stabilization, a low oil pressure condition is checked for, and if present, motor 14 is stopped, valves 32 and 80 are closed and valves 34 and 36 are set to lower the Vi and unload compressor 12 respectively, as indicated by block 114.

As indicated by block 115, if a condition of too high of a motor temperature is determined a sequence is initiated which will continue until the motor temperature is brought to an acceptable level, e.g. 165° F., or the system 100 is shut down responsive to the refrigeration requirements being met or due to motor temperature becoming excessive, e.g. 240° F. If the motor temperature is too high, e.g. ≧180° F., valve 70 is opened to permit the supplying of refrigerant to motor 14, as indicated by block 116. If supplying refrigerant is sufficient to lower the motor temperature to a temperature of 165° F., or less, as indicated by block 117, valve 70 is closed, as indicated by block 118. If, as indicated by block 119, the motor temperature is ≧220° F., valve 36 is adjusted via solenoid 36-1 to unload compressor 12, as indicated by block 120. If unloading compressor 12 is sufficient to bring the motor temperature to 205° F., or less, as indicated by block 121, the valve 36 is adjusted via solenoid 36-1 to reload compressor 12, as indicated by block 122. If the motor temperature falls to 165° F., or less, as indicated by block 123, valve 70 is closed, as indicated by block 118. If the motor temperature rises to 240° F., or above, as indicated by block 124, motor 14 is stopped, valves 32 and 80 are closed, valve 36 is adjusted to unload compressor 12 and valve 34 is adjusted to lower the Vi, as indicated by block 125.

As noted above, the motor temperature and discharge temperature are interrelated and the cooling of one causes the cooling of the other. If the discharge temperature is 205° F., or more, as indicated by block 126, a sequence is initiated which will continue until the discharge temperature is brought to an acceptable level, e.g. 190° F., or the system 100 is shut down responsive to the refrigeration requirements being met or due to discharge temperature becoming excessive, e.g. 230° F., refrigerant is supplied to motor 14 by opening valve 70, as indicated by block 127. If the discharge temperature falls to 190° F., or less, as indicated by block 128, valve 70 is closed, as indicated by block 129. If the discharge temperature rises to 230° F., or more, as indicated by block 130, motor 14 is stopped, valves 32 and 80 are closed, valve 36 is adjusted to unload compressor 12 and valve 34 is adjusted to lower the Vi, as indicated by block 125.

The shutting down of system 100, as indicated by block 125, due to an excess motor temperature or excess discharge temperature is self correcting in that the triggering temperature will eventually fall to 205° F., or less, in the case of the discharge temperature and the motor temperature. When the temperature of the motor is 205° F., or less, and the discharge temperature is 205° F., or less, as indicated by block 131, there is no uncorrected fault and the system returns to block 101 responsive to a request for refrigeration.

Although a preferred embodiment of the present invention has been described and illustrated, other changes will occur to those skilled in the art. For example other temperature ranges and parameters may be used. It is therefore intended that the scope of the present invention is to be limited only by the scope of the appended claims.

What is claimed is:

1. In a microprocessor controlled system including a motor, a compressor driven by the motor, a condenser, an expansion device, an evaporator, means for supplying refrigerant for cooling the motor, and compressor regulating means, a method for providing refrigeration responsive to a signal indicating a requirement for refrigeration including the steps of:

supplying power to an electronic module which is thereby placed in a power-on reset start-up routine including the serial steps of:

a) determining static discharge pressure;

b) starting the compressor;

c) determining the discharge pressure; and d) if the discharge pressure is more than 10 psi below the static discharge pressure within fifteen seconds after starting the compressor, the compressor is stopped;

sensing the motor temperature;

sensing the discharge temperature;

if the sensed motor temperature is at or above a first temperature, liquid refrigerant is supplied to the motor until the first temperature is lowered by a first predetermined amount;

if the sensed motor temperature exceeds the first temperature by a second predetermined amount, the motor is shut off;

if the sensed discharge temperature is at or above a second temperature, liquid refrigerant is supplied to the motor until the second temperature is lowered by a third predetermined amount;

if the sensed discharge temperature exceeds the second temperature by a fourth predetermined amount, the motor is shut off.

2. The method of claim 1 further including the steps of:

sensing the suction pressure;

sensing the oil pressure;

if the oil pressure does not exceed the suction pressure by a fifth predetermined amount for a predetermined continuous time period, the motor is shut off.

3. The method of claim 2 further including the steps of:

sensing the discharge pressure;

comparing the sensed oil pressure to the sensed discharge pressure;

if the sensed discharge pressure exceeds the sensed oil pressure by a sixth predetermined amount, the motor is shut off.

4. The method of claim 3 further including the steps of;

comparing the sensed suction and discharge pressure;

adjusting the compressor volume ratio to maintain the discharge pressure to suction pressure ratio within a predetermined range.

5. The method of claim 1 further including the steps of:

sensing the suction pressure;

sensing the discharge pressure; and adjusting the compressor volume ratio to maintain the discharge pressure to suction pressure ratio within a predetermined range.

6. The method of claim 1 further including the steps of:

determining the providing of power to the motor prior to starting the compressor;

if power to the motor is not detected, shutting down the system.

7. The method of claim 1 further including the step of:

if the sensed motor temperature is at a third temperature which exceeds the first temperature by a predetermined amount less than said second predetermined amount, unloading said compressor.

8. The method of claim 7 further including the step of:

reloading the compressor if the sensed motor temperature is reduced a predetermined amount.

9. The method of claim 1 further including the step of:

if the sensed discharge temperature is at a fourth temperature which exceeds the second temperature by a predetermined amount less than said third predetermined amount, stopping liquid refrigerant flow to the motor.

10. A refrigeration system including a closed circuit serially including a compressor, a condenser, an expansion device and an evaporator, further including a motor for driving said compressor, a refrigerant line branching downstream of said condenser and supplying liquid refrigerant to said motor for cooling comprising:

means for sensing suction pressure;

means for sensing discharge pressure;

means for sensing motor temperature;

means for sensing discharge temperature;

means for controlling compressor capacity;

means for controlling flow in said liquid refrigerant line;

means for starting said motor responsive to a request for refrigeration and for controlling said motor, said means for controlling compressor capacity and said means for controlling flow in said liquid refrigerant line;

said means for controlling said motor being controlled responsive to inputs from said means for sensing discharge pressure, said means for sensing motor temperature and said means for sensing discharge temperature;

said means for controlling compressor capacity being controlled responsive to inputs from said means for sensing suction pressure and said means for sensing discharge pressure;

and said means for controlling flow in said liquid refrigerant line being controlled responsive to inputs from said means for sensing motor temperature and said means for sensing discharge temperature.

* * * * *